US008056360B2

(12) United States Patent
Unmack

(10) Patent No.: US 8,056,360 B2
(45) Date of Patent: Nov. 15, 2011

(54) ABSORPTION REFRIGERATION PROTECTIVE CONTROLLER

(76) Inventor: Paul Neilson Unmack, Butte, MT (US)

( * ) Notice: Subject to any disclaimer, the term of this patent is extended or adjusted under 35 U.S.C. 154(b) by 467 days.

(21) Appl. No.: 11/824,923

(22) Filed: Jul. 3, 2007

(65) Prior Publication Data

US 2008/0115513 A1 May 22, 2008

Related U.S. Application Data

(60) Provisional application No. 60/860,980, filed on Nov. 22, 2006.

(51) Int. Cl.
*F25B 15/00* (2006.01)

(52) U.S. Cl. ..... 62/476; 62/479; 62/486; 62/489

(58) Field of Classification Search ..... 62/141, 62/145, 148, 158, 479, 486, 489
See application file for complete search history.

(56) References Cited

U.S. PATENT DOCUMENTS

| | | | | | |
|---|---|---|---|---|---|
| 2,948,124 | A | | 8/1960 | Embury | |
| 3,101,780 | A | * | 8/1963 | Smith | 165/166 |
| 3,262,282 | A | * | 7/1966 | Aronson | 62/141 |
| 4,257,758 | A | * | 3/1981 | Blomberg | 431/27 |
| 4,362,029 | A | * | 12/1982 | Blomberg et al. | 62/497 |
| 5,682,755 | A | * | 11/1997 | Uchida et al. | 62/148 |
| 5,724,823 | A | * | 3/1998 | Martini et al. | 62/148 |
| 6,282,918 | B1 | * | 9/2001 | Levin et al. | 62/476 |
| 6,397,625 | B1 | * | 6/2002 | Kunze | 62/476 |
| 6,487,875 | B1 | * | 12/2002 | Sarkisian et al. | 62/497 |
| 6,655,171 | B2 | | 12/2003 | Korinth | |
| 6,748,752 | B2 | * | 6/2004 | Sarkisian et al. | 62/149 |
| 7,050,888 | B2 | * | 5/2006 | Schneider et al. | 700/300 |
| 2002/0162341 | A1 | | 11/2002 | Yamazaki | |
| 2005/0022963 | A1 | * | 2/2005 | Garrabrant et al. | 165/58 |
| 2005/0126192 | A1 | | 6/2005 | Halwan | |

OTHER PUBLICATIONS

Dometic, Installation and Operating Instructions for Model NDA1402, Form No. 825123401 MO-FO 0513, 2005 Dometic Corporation Lagrange, IN 46761.

Bob Livingston, Off-Level Fridge, Good Sam Club—Highways Magazine, Feb. 2011 Issue, pp. 22 and 53, vol. 45, No. 2 Published by Affinity Group, Inc., 2575 Vista Del Mar Drive, Ventura, California 93001.

* cited by examiner

*Primary Examiner* — Frantz Jules
*Assistant Examiner* — Emmanuel Duke

(57) ABSTRACT

The present invention provides an improved control system and method for the absorption refrigeration process. The system includes sensors that measure the absorption process in order to determine if the absorption cycle is continuous. A control unit in communication with the sensors which compares the measured sensor values to predetermined safe limits. When the control unit determines that safe limits have been exceeded, the control unit communicates with actuators adjusting the absorption cycle heat source, ultimately protecting the absorption refrigeration process from damage. Further, the control may reestablish the absorption cycle heat source when predetermined safe operation conditions are detected.

13 Claims, 6 Drawing Sheets

Figure 1A:
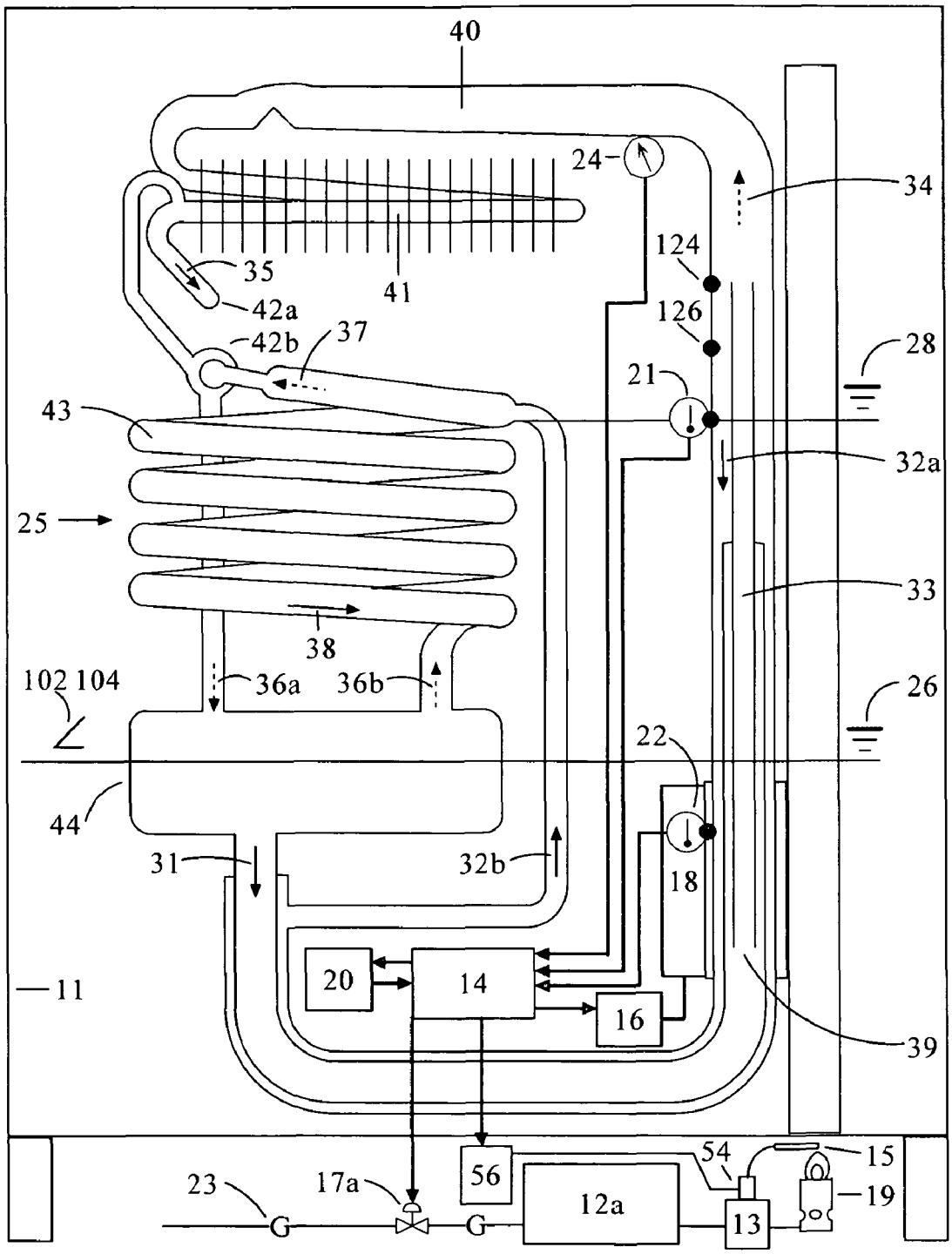

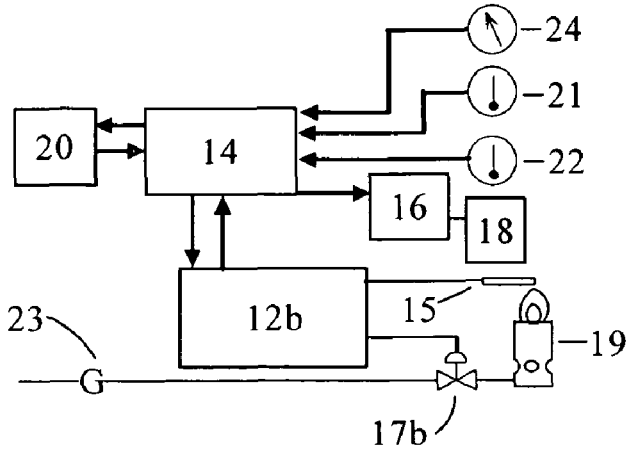
Fig. 1B
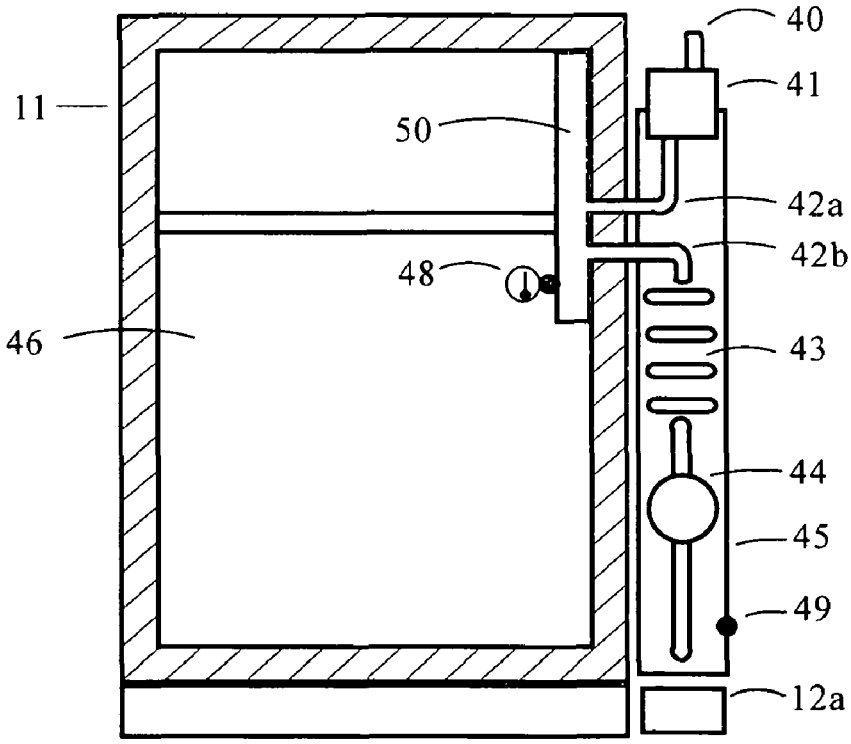
Fig. 2 –Prior Art–

ABSORPTION REFRIGERATION PROTECTIVE CONTROLLER

CROSS-REFERENCE TO RELATED APPLICATIONS

This application claims the benefits of provisional patent application No. 60/860,980 filed Nov. 22, 2006 by the present inventor.

FEDERALLY SPONSORED RESEARCH

Not Applicable

SEQUENCE LISTING

Not Applicable

BACKGROUND OF INVENTION

1. Field of Invention

This invention improves control of the single pressure absorption refrigeration process, specifically it controls the cooling unit heat source when circulation of the refrigerant ceases.

2. Objectives and Advantages

Many applications use the single pressure absorption refrigeration (SPAR) system where portability is desired. The SPAR system does not have a mechanical pump whereas the dual pressure absorption system utilizes a mechanical pump. See Patent Application Pub. No. US 2005/0126192 for an example of a dual pressure absorption system. Mechanical pumps require an energy source therefore SPAR systems are ideal for applications where municipal power is not available. A few applications for the SPAR system are stand alone portable freezers and refrigerators, boats, recreational vehicles (RVs) and other transportation devices which require refrigeration storage. In addition to portable applications, the SPAR system is used in remote stationary applications. It came to the inventor's attention that the SPAR system will be destroyed by prolonged periods of operation when the absorption cycle has ceased.

The SPAR system requires an energy source to drive the absorption cycle. The energy source typically comes in the form of heat input to the cooling unit. The cooling unit is the assembly containing the absorption cycle. The energy or heat driving the absorption cycle is calibrated for a continuous cycle. When the absorption cycle ceases, continued heat input to the cooling unit results in system destruction. One form of system destruction is the thermo stresses introduced into the cooling unit tubing. Cracking and rupturing of the cooling unit tubing may result from repeated application of excessive thermo stresses. Under certain conditions, a cooling unit tubing rupture may result in a dangerous fire. Another form of system destruction can occur when the inhibitor is concentrated and crystallized. Finally, refrigeration stops when the absorption cycle ceases therefore energy is wasted.

When the SPAR is stationary, the cooling unit must be leveled according to the manufactures instructions/operator's manual in order to operate in a continuous cycle. In a vehicle application, typically the manufactures' operation manual states that the SPAR may be operated while in transit. The motion of transit prevents the refrigerant from pooling, where pooling is the primary cause of refrigerant cessation. During phases of transportation, such as brief rest stops, it is not always practical or convenient to level the system. One operator's manual states that if the vehicle is parked for several hours, and the refrigerator is operating, the vehicle should be leveled. The inventor destroyed a refrigerator by this method of operation assuming that less than two hours of operation off-level would not damage the system. This event led to the recognition by the inventor that an improved cooling unit heat source controller was needed.

In the stationary refrigeration application, it is desirable to reduce the amount of refrigerant in the system thereby making the system more efficient. See. U.S. Pat. No. 6,655,171 to Korinth (2003). An improved heat source controller which maintains tighter temperature and pressure limits preventing cessation of the refrigerant would benefit the system found in U.S. Pat. No. 6,655,171.

The inventor recognized that a control system would prevent the premature failure, possible fire hazard, and maintain cooling unit performance of a SPAR system by monitoring the cooling unit parameters and taking appropriate action when cessation of the refrigerant occurred. This led to the research and development of the absorption refrigeration protective controller (hereafter ARP controller).

3. Brief Discussion of Prior-Art

After performing a market, technical document, and patent search, no commercial devices or technical documents directly address the cessation of refrigerant problem or offered any obvious control solutions. U.S. Pat. No. 7,050,888 to Schneider et al. (2006) teaches that the: claimed device saves energy, but the device does not address system destruction by off-level operation. The only other prior-art found was a thermo-fuse which attempts to prevent fires due to overheating of the boiler casing. The thermo-fuse did not offer a solution for off-level operation system destruction. Rather, the thermo-fuse appeared to protect electrical equipment and not the SPAR cooling unit. Further discussion of prior-art, including test data, may be found in the Detailed Description sections below.

SUMMARY

The present invention is directed to a SPAR suitable for both uses by vehicles or in stationary applications. More particularly, the present invention is directed to extend the life of the cooling unit, thereby making the refrigeration system more reliable and economical to operate. Further, reduced need to dispose of hazardous refrigerant from failed absorption refrigerators is an added benefit.

The present invention includes a control method consisting of (a) sensors which measure cooling unit parameters (b) a control unit which determines when safe parameters have been exceeded and (c) actuators which adjust the level of heat input to the cooling unit thereby maintaining safe operation of the SPAR system. The present invention will also inform the operator that cooling unit heat source control has been activated, and where applicable, go through a finite number of automatic restarts once safe operation conditions are detected. These and other features, aspects, and advantages of the present invention will become better understood with reference to the following drawings, descriptions, and claims.

DRAWINGS

BRIEF DESCRIPTION

FIG. 1A, rear view of a typical SPAR unit with an adaptation of the present invention. The boiler assembly casing has been omitted for clarity.

FIG. 1B, typical automatic control for SPAR unit with an adaptation of the present invention. The refrigeration cooling unit and cabinet have been omitted for clarity.

FIG. 2, cross-sectional side view of typical SPAR unit with prior-art location for thermo-fuse.

Figure 3:
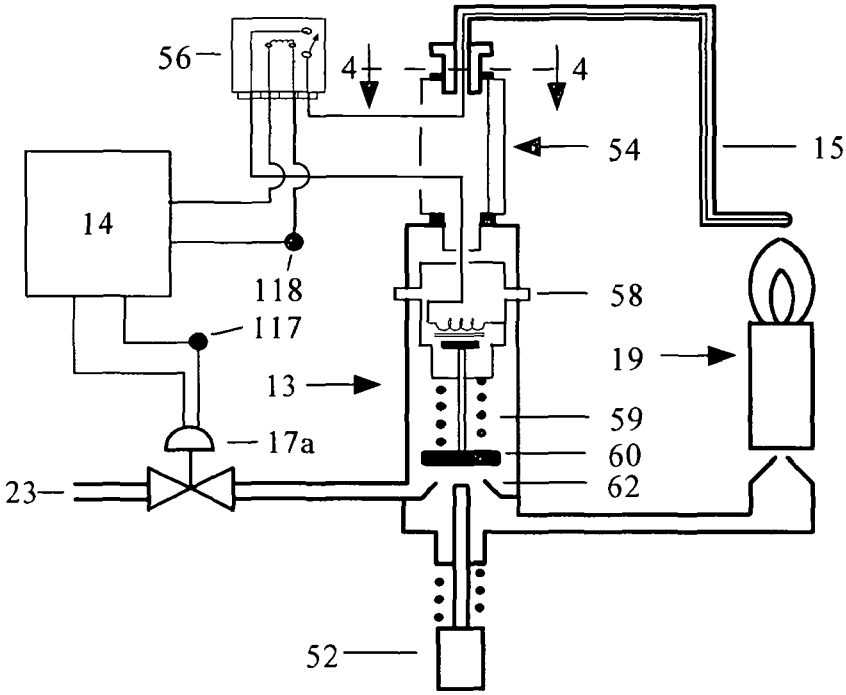

FIG. 3, cross sectional view of a manufacturers' manual gas safety control valve with an adaptation of the present invention applying the novel adaptor to interrupt the manufactures' safety thermocouple signal.

Figure 4:
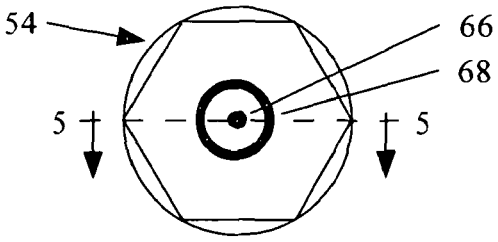

FIG. 4, top view of the novel thermocouple interrupt (TCI) adaptor.

Figure 5:
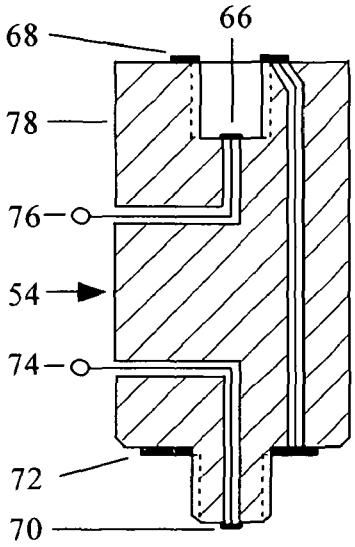

FIG. 5, cross sectional side view of the novel TCI adaptor.

Figure 6:
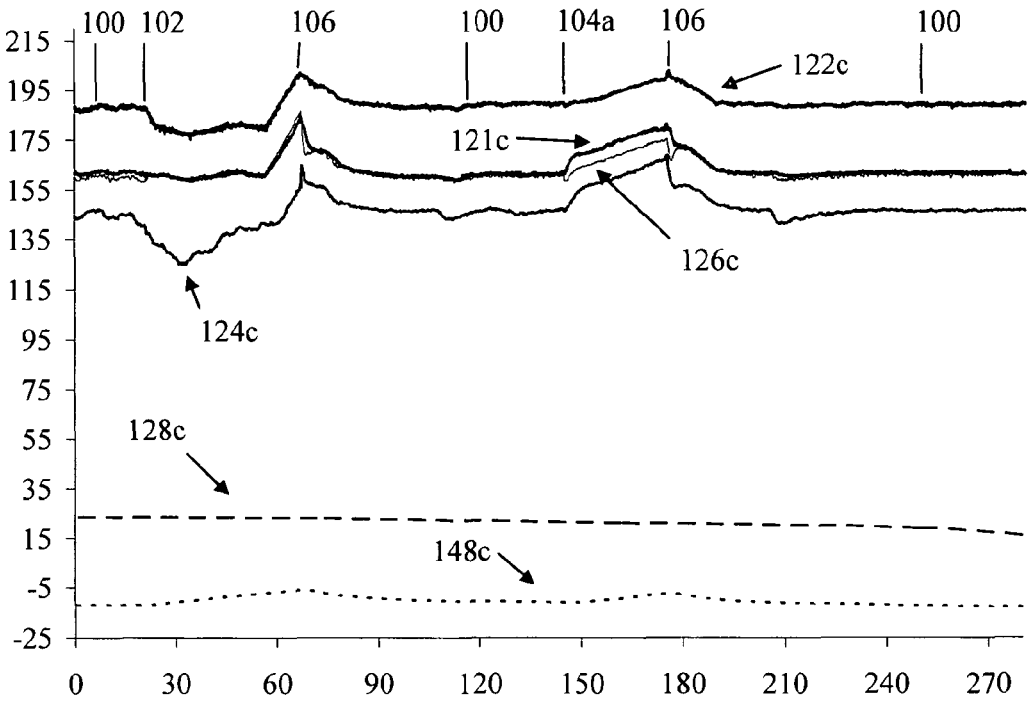

FIG. 6, plot of temperatures at differing locations on the SPAR cooling unit during steady state (SS) operation and when the absorption refrigeration unit is operated off-level. Note: On all plots the abscissa is time in the units of minutes and the ordinate is temperature in the units of degrees Celsius on primary axis and Volts on secondary axis (right).

Figure 7:
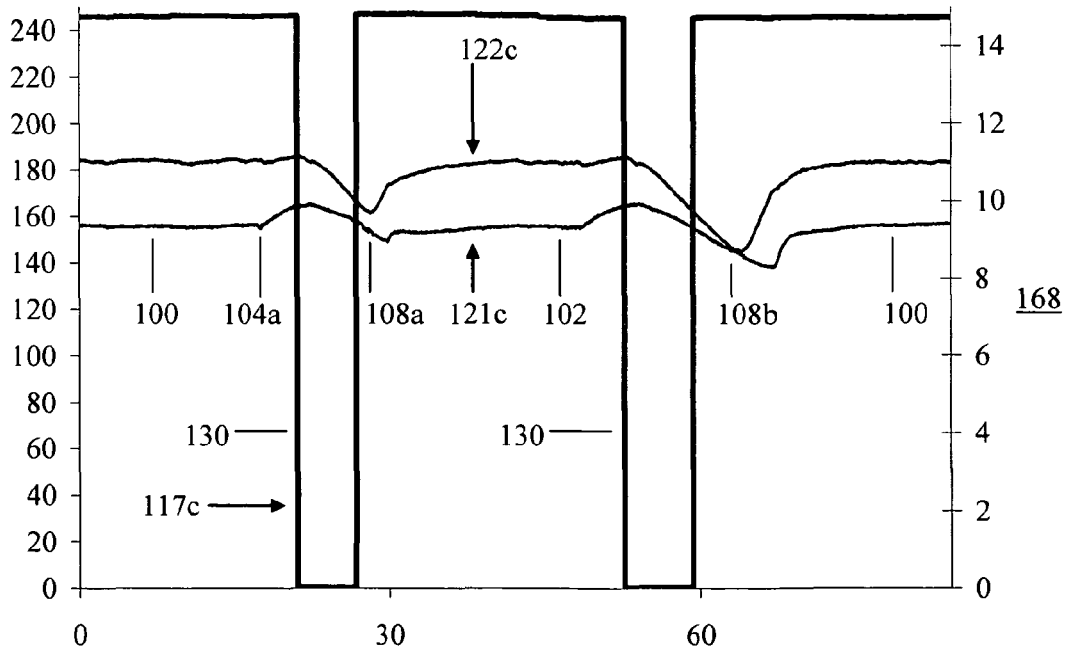

FIG. 7, plot of temperatures at differing locations on the SPAR cooling unit. Solenoid operated valve activation signal curve (117*c*) is read from secondary axis (right).

Figure 8:
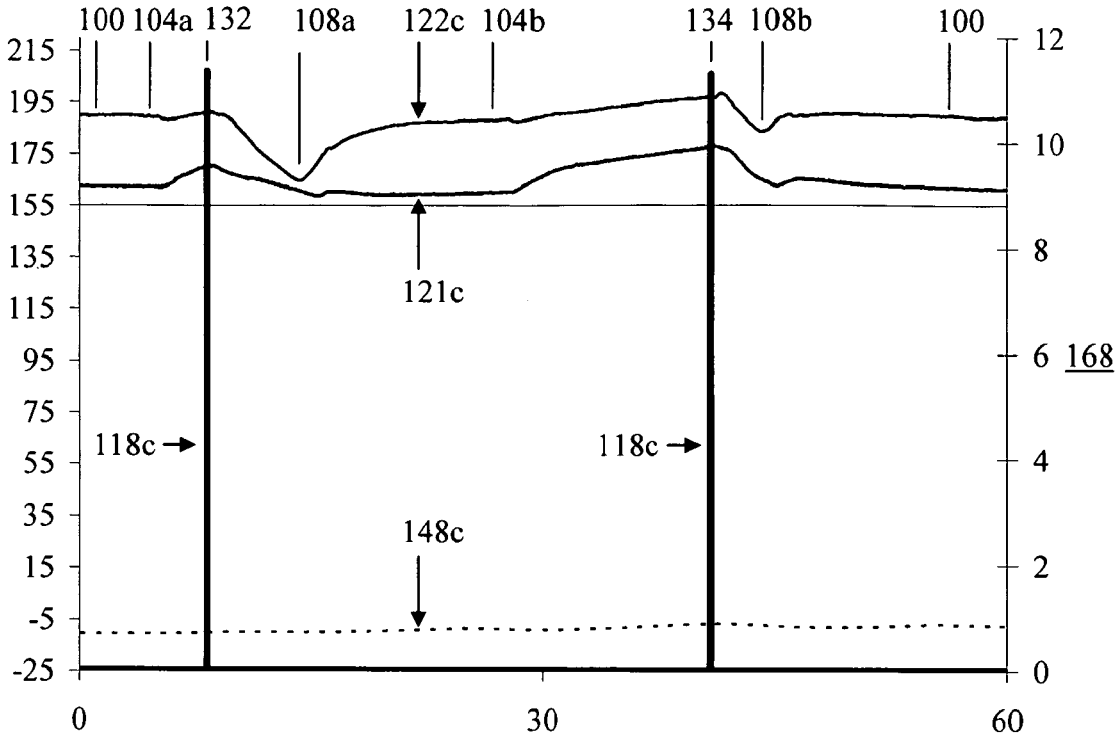

FIG. 8, plot of temperatures at differing locations on the SPAR cooling unit. Interrupt relay activation signal curve (118*c*) is read from the secondary axis (right).

Figure 9:
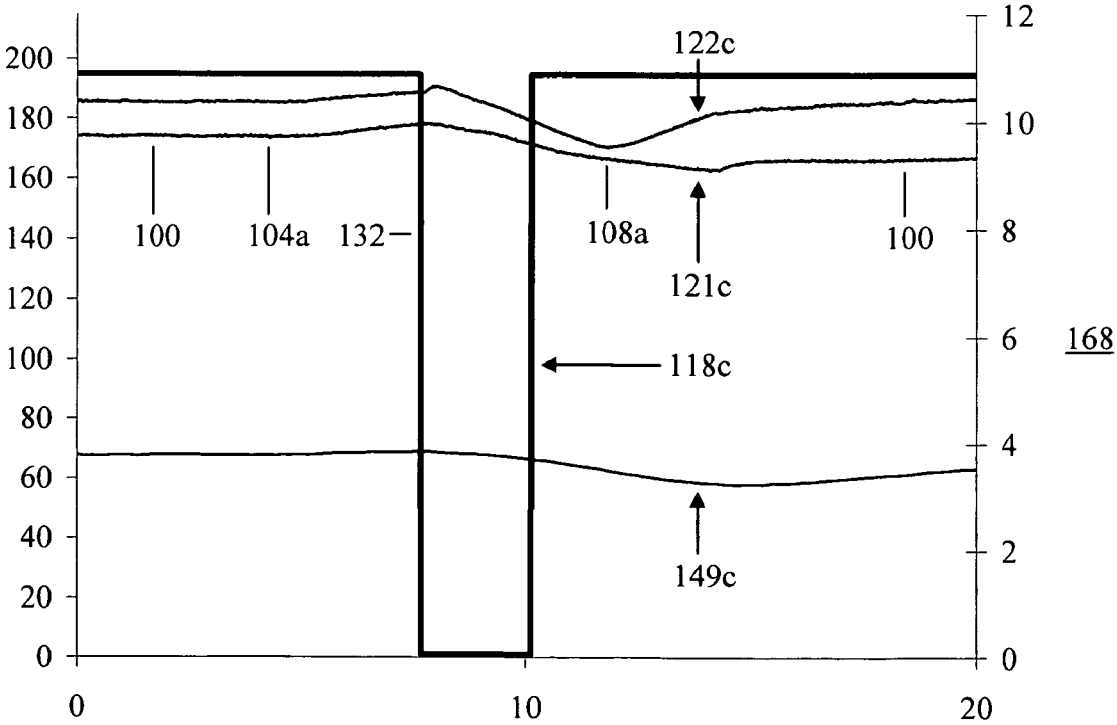

FIG. 9, plot of the temperatures at differing location on the SPAR cooling unit. Interrupt relay activation signal curve (118*c*) is read from the secondary axis (right).

Figure 10:
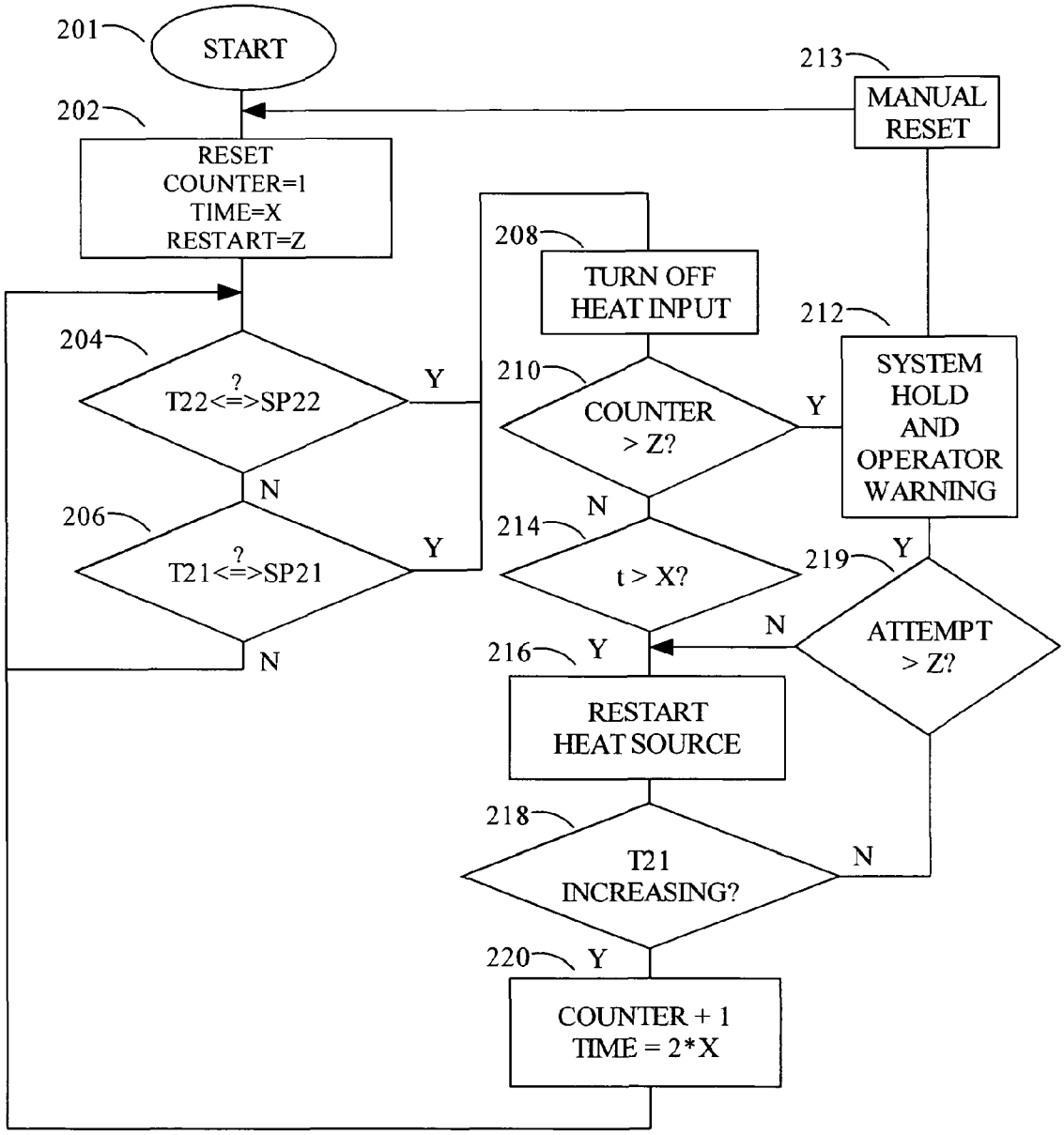

FIG. 10, representative flow chart for a microprocessor based controller.

REFERENCE NUMBERS AND ACRONYM

11 Refrigerator cabinet.
12*a* Manufacturers' manual cooling unit controller (MMC).
12*b* Manufacturers' automatic cooling unit controller (MAC).
13 Manufacturers' manual gas safety control valve (MG-SCV).
14 Present invention control unit (ARP controller).
15 Manufacturers' safety thermocouple (STC).
16 Present invention relay for switching electrical heat source.
17*a* Present invention gas heat source control solenoid operated valve (SOV).
17*b* Manufacturers' automatic controller SOV.
18 Electrical heating elements.
19 Gas heating burner assembly.
20 Present invention control panel.
21 Present invention temperature sensor measuring at weak solution fluid level.
22 Present invention temperature sensor measuring heat input at boiler.
23 Gas supply pipe.
24 Present invention pressure sensor.
25 Absorption refrigeration cooling unit.
26 Refrigerant fluid level.
28 Weak solution fluid level.
31 Flow direction of refrigerant from tank to boiler.
32*a* and 32*b* Flow direction of weak solution or solvent to absorber.
33 Pump tube.
34 Flow direction of gas working agent (ammonia) to condenser.
35 Flow direction of liquid working agent to evaporator.
36*a* Flow direction of ammonia and assistant gas to absorber from evaporator.
36*b* Flow direction of ammonia and assistant gas through absorber.
37 Flow direction of assistant gas to evaporator.
38 Flow direction of refrigerant to holding tank.
39 Boiler.
40 Water separator.
41 Condenser.
42*a* Liquid ammonia entering evaporator.
42*b* Manifold exiting evaporator.
43 Absorber coil.
44 Refrigerant holding tank.
45 Boiler assembly casing.
46 Refrigerated space.
48 Prior-art evaporator temperature sensor.
49 Prior-art boiler casing thermo-fuse.
50 Evaporator.
52 Manual safety valve push-button.
54 Thermocouple interrupt adaptor (TCI).
56 Interrupt relay.
58 Valve latching solenoid (VLS).
59 VLS return spring.
60 Valve plunger.
62 Valve seat.
66 STC center electrical contact.
68 STC outer electrical contact.
70 VLS center electrical contact.
72 VLS outer electrical contact.
74 Wire from interrupt relay.
76 Wire to interrupt relay.
78 Interrupt adaptor body.
100 Steady state operation (SS).
102 Tilt entire SPAR 5.7 degrees clockwise (CW).
104*a* Tilt entire SPAR 5.7 degrees counterclockwise (CCW).
104*b* Second event same as 104*a*.
106 Return to level.
108*a* Return SPAR to level and reignite burner.
108*b* Second event same as 108*a*.
117 SOV signal measurement point.
117*c* SOV activation signal curve.
118 Interrupt relay measurement point.
118*c* Interrupt relay activation signal curve.
121*c* Temperature curve measured at weak solution temperature sensor 21.
122*c* Temperature curve measured at burner temperature sensor 22.
124 Temperature measurement point.
124*c* Temperature curve measured at point 124.
126 Temperature measurement point.
126*c* Temperature curve measured at point 126.
128*c* Ambient temperature curve.
130 SOV 17*a* shuts off fuel supply to burner 19.
132 Present invention triggers from sensor 21 activating interrupt relay 56.
134 Present invention triggers from sensor 22 activating interrupt relay 56.
148*c* Prior-art temperature sensor curve measured at temperature sensor 48.
149*c* Prior-art temperature sensor curve measured at thermo-fuse 49.
168 Secondary ordinate.

DETAILED DESCRIPTION

Absorption Refrigeration Theory of Operation—FIG. 1A and FIG. 2

The discussion of the SPAR theory of operation is included to aid the reader in an understanding of how the present invention works. While I believe the following description of operation of the SPAR to be accurate, I do not wish to be bound by this description.

Referencing FIG. 1A, a typical SPAR cooling unit (25) in accordance with a preferred embodiment of the present invention may be seen. Starting at the refrigerant holding tank (44), a supply of refrigerant is delivered to the boiler or still (39). The direction of flow is defined by arrow 31. The liquid refrigerant is typically a soluble mixture of ammonia and water, where water is the solvent, with an inhibitor such as chromate. Energy in the form of heat is added from the electrical heater (18) or the combustible gas (19) at the boiler (39). The result is for the ammonia to come out of solution as a gas. Water has a higher boiling point than ammonia so the water remains liquid at the pressures and temperatures in the boiler. As a result of the design of the boiler the ammonia is distilled or separated from the water and chromate. The ammonia gas and liquid water are transported up the pump tube (33) similar to the pump effect found in a coffee percolator. At the top of pump tube (33) the majority of the water and chromate drop down by the effect of gravity in the direction of flow indicated by arrow 32*a*. Any water vapor that may proceed upward will condense in the water separator (40) and return down in the direction indicated by arrow 32*a*. The water and chromate are depleted of ammonia flowing in the direction of arrows 32*a* and 32*b*. Therefore, flow 32*a* and 32*b* are referred to as the weak solution or solvent.

From the pump tube (33) the ammonia gas flows in the direction indicated by arrow 34 past the water separator (40) and to the condenser (41) where the ammonia gas is cooled resulting in re-liquefaction of the ammonia. From the condenser (41), the liquid ammonia flows in the direction of arrow 35 into the evaporator (50), found in FIG. 2, through the wall of the refrigerated compartment (11) at location 42*a*. Once the liquid ammonia flows into the evaporator, the liquid ammonia comes into contact with the assistant gas which is typically hydrogen. Due to partial pressure, the ammonia evaporates into the assistant gas resulting in absorption of heat from the refrigerated space (46), see FIG. 2. From the evaporator (50) the ammonia and hydrogen gas exit through the lower manifold (42*b*) in the outer annular tube in the direction of flow indicated by arrow 36*a*, found in FIG. 1A. The ammonia and hydrogen gas pass through the upper portion of the holding tank (44) and begin ascending through the absorber coil (43) in the direction of flow indicated by arrow 36*b*. Within the absorber coil (43) the ammonia and hydrogen gas come into contact with the weak solution which flows by the influence of gravity into the top of the absorber coil (43) from the boiler assembly (39) in the direction of flow indicated by arrow 32*b*. Due to the affinity of ammonia for water, the ammonia gas returns into the weak solution liberating the assistant gas to return to the evaporator (50) in the direction of flow indicated by arrow 37, by way of the inner annular tube of the lower manifold (42*b*) which completes the assistant gas circuit.

The reconstituted liquid refrigerant returns after being decomposed, in the boiler (39) and reconstituted in the absorber coil (43) in the direction of flow (38) to the holding tank (44) which completes the refrigerant circuit.

Manufactures' Control Methods—FIG. 1A, FIG. 1B, and FIG. 3

SPAR systems are equipped with a manufactures' controller (MC) which maintains the desired temperature within the refrigerated space (46). The present invention may be better understood with knowledge of the MC methods. There are two primary types of MC. The first type of MC is a manual controller as seen in FIG. 1A. For refrigerators equipped with the manufacturers' manual controller (MMC), the heat source is selected manually by the operator. If the gas heat source is selected by the operator, the operator manually ignites the flame for gas heat input to the cooling unit. Once the flame is lit, the temperature is regulated in the refrigerated space by the MMC (12*a*), which modulates the flame to a high or low state.

When cooling is required in the refrigerated space the MMC is in the high flame state maintaining the refrigeration cycle. The low flame state does not provide enough heat to maintain the refrigeration cycle, therefore this is a dormant state for the cooling unit. The MMC high/low state function allows the flame to remain lit all of the time while maintaining a constant temperature in the refrigerated space (46). Referring to FIG. 1A, part 13 is a manufactures gas safety control valve (MGSCV) shown in detail in FIG. 3. In order to ignite the burner (19) of a refrigerator with the MGSCV (13) the operator will turn on the gas to the burner by pressing the manual safety valve push-button (52). By pressing the manual safety valve push-button (52) the valve plunger (60) is lifted off of its seat (62) which allows gas to flow to the burner assembly (19). The operator will ignite the combustible gas which will heat the STC (15). The heating of the STC (15) produces a voltage which creates a magnetic field in the valve latching solenoid (VLS) (58). This magnetic field has enough force to overcome the force of the VLS return spring (59). As long as the STC (15) is heated by the gas flame, the MGSCV (13) remains open. If the flame is extinguished, the STC (15) will cease to supply voltage to the VLS. The result is for the return spring (59) to return the valve plunger (60) to its seat (62) which stops the flow of gas to the burner (19).

The second type of MC is a manufacturers' automatic controller (MAC) which uses logic to turn on and off the heat source to maintain a constant temperature in the refrigerated space. Referring to FIG. 1B, typically the MAC (12*b*) will turn on the heat input when refrigeration is required. For gas heat input, the MAC sends a signal to the SOV (17*b*) to open, and then an automatic igniter lights the burner (19). Once the burner is ignited the cooling unit begins the refrigeration cycle. The MAC can also have logic functions to select between different heat sources such as AC, DC, or LP gas heat input.

Prior-Art Controller—FIG. 2 and FIG. 6

The following tests were preformed in order to check the practicality of the prior-art temperature sensor (U.S. Pat. No. 7,050,888 to Schneider et al. 2006) for use as a protective control. The tests were preformed under steady state (SS) and off level conditions with an uninterrupted heat source. The initial SS conditions (100) in all figures are defined by the cooling unit (25) being level with a continuous heat source applied until the temperature within the refrigerated space (46) is at least 15 degrees Celsius (59 degrees Fahrenheit) below ambient temperature. The aforesaid test standard for the initial SS conditions assured that the absorption cycle was continuous prior to data collection.

Referring to FIG. 6, a typical SPAR has been instrumented to read the cooling unit process temperatures. The locations of the temperature sensors are given in FIG. 1A and FIG. 2 with the corresponding temperature curves found in FIG. 6. For example, the corresponding curve for the prior-art temperature sensor (48) measuring the refrigerated space (46) is found in FIG. 6 and is identified by an arrow and curve number 148*c*. Ambient temperature curve 128*c* has been provided as a reference for the test environment conditions. The events along the curves reading from left to right have been identified by numbers. For example, in FIG. 6 event 100 is the initial SS temperatures leading up to event 102 where the refrigerator is tilted from level. At event 102 the refrigerator is tilted clockwise (CW) away from the refrigerant fluid level (26) as viewed in FIG. 1A to an angle of 5.7 degrees and left in this position until the refrigerator is returned to level at event 106. From event 106, the refrigerator resumes SS operation identified by event 100. At event 104*a* the refrigerator is tilted counterclockwise (CCW) until event 106 where the refrigerator is once again returned to level to resume SS operation (100). Please note that 5.7 degrees has been used as a consistent test angle for comparison in this document. The present invention will protect the SPAR at any angle of tilt where damage may occur.

It is apparent from FIG. 6 that once the refrigerator is tilted at event 102, curve 122*c* decreases in temperature while curve 121*c* remains close to SS. After being at this angle for approximately 30 minutes the temperature starts rapidly increasing to event 106. Due to the thermal inertia of the refrigerated space and its contents the temperature at prior-art sensor 48, curve 148*c*, has very little change when compared to curves 121*c*, 122*c*, 124*c*, and 126*c*. Further, the interpretation of a temperature change at point 48 is difficult because it is impossible to distinguish "off-level" caused warming of the interior of the refrigerator from events such as opening the door or placing warm food near the temperature sensor (48). Sensor (48) is only useful to provide a warning that some unidentified condition has arisen that affects the refrigerated space (46) temperature. Prior-art sensor 48 is not at all useful as an input to a control that protects the SPAR cooling unit from off-level overheating damage because it would initiate unnecessary shutdowns in the situations described above.

Prior-Art Thermo-Fuse—FIG. 2 and FIG. 9

By referring to FIG. 9, tests were preformed to determine if the prior-art thermo-fuse (49) would offer an effective control solution for the measurement of refrigerant cessation. The descriptions of the curves and the corresponding event numbers are the same as previous figures. When the cooling unit is tilted at event 104*a*, slight temperature change occurs at the thermo-fuse (49) location, curve 149*c*. The lack of response is because the boiler casing is to provide an insulation layer separating the boiler (39) and heat sources from ambient conditions. As a result of the thermo-fuse being mounted on the ambient side of the insulation, the thermo-fuse measurement will reflect both boiler temperature and ambient conditions resulting in an indirect reading (passive measurement) of the cooling unit parameters. The thermo-fuse (49) is useless for the protection of the cooling unit because it will only react to extreme temperature changes in the proximity of the cooling unit boiler.

Preferred Embodiment

In the following description, for the purposes of explanation and not limitations, specific details are set forth such as particular techniques and applications in order to provide a thorough understanding of the present invention. However, it will be apparent to one skilled in the art that the present invention may be practiced in other embodiments that depart from these specific details. In other instances, detailed descriptions of well-known methods and apparatuses are omitted so as not to obscure the description of the present invention with unnecessary details.

With an understanding of the MC methods, the absorption cycle, and the function of the heat input driving the absorption cycle, an explanation of the mode of operation for the present invention may be better understood. The previously described absorption refrigeration cycle is dependent on a number of variables, including but not limited to, heat input and the system being level so that the cycle may be completed without pooling of the refrigerant or any of the refrigerant's components. When the SPAR system is not level and cessation of refrigerant occurs, the refrigeration cycle is interrupted or completely stopped. In turn, there is either a reduction of cooling within the refrigerated space (46) or no cooling at all. When the previously described condition occurs, continued heat input leads to the destruction of the system.

The heat input at the boiler (39) is calibrated for a continuous cycle. When the cycle is in normal operation a steady temperature maybe measured at the boiler (39) and at the weak solution fluid level (28). The SS temperature at the boiler (39) is due to the continuous phase change of the ammonia (latent heat). The SS temperature at the weak solution fluid level (28) is due to the continuous flow of the weak solution. Please note that two different models of SPAR systems are represented, each model having unique cooling unit parameters. FIGS. 6, 7, and 8 are data for one model and FIG. 9 is the second model. Referring to FIG. 6, the SS temperature (100) measured at the boiler heat input sensor (22), curve 122*c*, at approximately 12 minutes is 190 degrees Celsius (374 degrees Fahrenheit). The corresponding weak solution sensor (21), curve 121*c*, SS temperature is approximately 160 degrees Celsius (320 degrees Fahrenheit). By the inventor's experimentation, data collection, and observation it was determined that when the temperature measured at sensor 21 exceeded 165 degrees Celsius (329 degrees Fahrenheit) the absorption cycle had ceased and damage to the system will follow if the heat source is not adjusted. As a result, the ARP controller was designed and implemented reducing the theory to practice.

Although the methods of controlling the heat input for a MMC or MAC system are similar, FIG. 1A and FIG. 1B have been included to assist the reader in an understanding of the differences in control method and how the present invention functions with either type of MC. Both MC adjust the heat source in order to control the refrigeration process. By circuitry changes to the present invention, output signals of the invention will adjust any energy source driving the SPAR. This document focuses on control of gas heat input (19) to the SPAR cycle. Discussion of actuation of the electric heat source using devices such as relay (16) is omitted for clarity. The present invention will cooperate with either type of MC and can be a digital (microcontroller) or analog signal processing device, which ever method is best suited for the particular application under consideration. Finally, there are many mechanisms which will cause a discontinuity of the absorption cycle. Off-level cessation of the refrigerant is the only mechanism addressed by this document. The present invention will protect the SPAR unit regardless of the cause of cessation.

Manual Controller SOV Actuator—FIG. 3 and FIG. 7

FIG. 3 is a detailed cross-sectional view of a typical MGSCV (13) introduced in FIG. 1A. One method of controlling the gas heat input which will function independently from the MGSCV is to use a normally open solenoid operated valve (SOV). When SOV (17*a*) is activated the gas from the supply line (23) is turned off and the MGSCV closes due to a no flame condition as described above.

Referring to FIG. 7, the ARP control unit (14) regulates the gas heat input by actuating SOV (17*a*) when an unsafe operating condition is detected. Reading the curves from left to right, the cooling unit is operating at SS (100). At event 104*a* the entire refrigeration unit is tilted 5.7 degrees CCW. The temperature measured at the burner sensor (22), curve 122*c* remains fairly constant. In contrast, the weak solution temperature (curve 121*c*) begins to increase rapidly. The ARP control unit (14) activates SOV (17*a*) when the weak solution reaches 165 degrees Celsius (329 degrees Fahrenheit) at event 130, ultimately protecting the integrity of the system. At event 108*a* the refrigeration unit is returned to level and the burner (19) is reignited restoring the heat input. Once the system returned to SS, the entire refrigeration unit is tilted 5.7 degrees CW at event 102 in order to confirm functionality of the controller in both directions.

Once the ARP Controller intervened in the normal operation of the system a warning was displayed on the control panel (20) so that the operator was aware of a potential problem. In addition, the warning informed the operator that the refrigerator required a manual restart after a correction of any potential problem such as the cooling unit not being level.

Manual Controller Interrupt Adaptor Actuator—FIG. 3, FIG. 4, FIG. 5 and FIG. 8

As a result of the inventor's research and development, and the desire to lower the cost of the invention for the end user, the inventor recognized that if the signal from the STC (15) could be interrupted before it reached the MGSCV (13); the gas heat source may be actuated by the APR controller. Such a method of control would eliminate the need for SOV 17*a* entirely. The inventor designed and reduced to practice a novel method to manipulate the MGSCV (13) input signal. For the SPAR system under consideration, the novel thermocouple interrupt (TCI) adaptor (54) was implemented. With reference to FIGS. 3, 4, and 5, the TCI adaptor taps into the center wire of the STC (15) at electrical contacts 66 and 70. In order to interrupt the signal between the STC (15) and the VLS (58), contacts 74 and 76 are connected to a normally closed interrupt relay (56) which completes the connection for normal SPAR operation. When the ARP controller detects a potentially destructive condition for the cooling unit a signal is sent to the interrupt relay (56) actuating a shut down of the gas heat source. Finally, to complete the circuit, electrical contacts 68 and 72 establish an electrical connection between the outer conductor of the STC (15) and the VLS housing (58). The body of the interrupt adaptor (78) is made of a non-conductive material.

With reference to FIG. 8, the method of STC signal manipulation using the interrupt adaptor method of control is implemented. Further, FIG. 8 demonstrates the results of triggering the APR controller from different locations on the SPAR cooling unit. Beginning on the left side of the plot, SS (100) operation is present up to tilting the cooling unit CCW at event 104*a*. The ARP controller is set to trigger from the weak solution signal (121*c*) or the burner signal (122*c*). It is clear that the weak solution (121*c*) reacts more rapidly than the burner (122*c*). At event reference 132, the control unit (14) turns off the gas heat input triggering from the weak solution sensor (21). At event 108*a* the SPAR is leveled, the heat source is reestablished, and the weak solution signal (121*c*) is turned off so that the control unit (14) can not trigger from the weak solution sensor (21). At event 104*b*, the SPAR is tilted CCW and the control unit (14) triggers from the burner signal (122*c*) at event 134. Again the SPAR is leveled at event 108*b* and the system returns to SS.

Comparing the two tests in FIG. 8, when the weak solution temperature sensor (21) triggered the control unit (14) between events 104*a* and 132, the duration was approximately 4 minutes. This is compared to 17 minutes between events 104*b* and 134 when triggering from the burner temperature sensor (22). When the weak solution temperature sensor (21) triggered the control unit (14) at reference 132 the burner temperature (22) was still below 192 degrees Celsius (377 degrees Fahrenheit). It is clear that the weak solution temperature sensor (21) is an ideal location for the ARP controller to sense an off-level condition and respond before undue thermal stress is placed on the cooling unit (25). Further, by observing curve 148*c* measured at the prior-art temperature sensor (48) there is not a significant change of temperature. Because thermo-fuse (49) indirectly senses in the proximity of the burner it would take well in excess of 17 minutes to react which would ultimately damage the system. It may be concluded that the signal from sensor 48 or thermo-fuse 49 are not of use for detecting a potentially destructive condition.

By comparison of FIG. 7 and FIG. 8, the present invention has been adapted to control the gas heat input for a MMC using two separate methods. The difference between curve 117*c* in FIG. 7 and curve 118*c* in FIG. 8 is merely a change in the output circuitry of the control unit (14) and the method of activation for the heat source. The novel TCI adaptor (54) performs the same task as SOV (17*a*); therefore TCI adaptor (54) can replace SOV (17*a*) entirely on a MMC system.

Automatic Controller—FIG. 1B, and FIG. 10

The MAC essentially has the same primary control needs as the MMC. The primary needs of the MAC being adaptations of the ARP controller circuitry for sensing an unsafe operating condition and responding by activating an adjustment of the appropriate heat source. Similar to the MMC, the present invention will manipulate signals going to and from the MAC. Where the functions of the ARP controller can differ will be the use of the automatic restart feature of the MAC. For example, if the control unit (14) turned off the heat source to the cooling unit because the refrigerator was not level for a limited time, such as stopping at a rest area during transit, the ARP controller will use logic functions to detect when a safe restart is practical.

By referring to FIG. 10, a sample flow chart may best model a method of the ARP controller to adjust the heat source. The flow chart in FIG. 10 illustrates a method of control rather than limit the scope of the invention. The ARP controller will have system variables which may be set according to the particular SPAR unit which it is controlling. The system variables may include the time delay X and the restart variable Z. In addition, the set point (SP) for the particular cooling unit measurement point will be stored in memory as variables to account for differences between cooling units and their unique operating parameters.

Starting with step 201, the control unit (14) is switched on initiating the logic sequence. Step 202, upon initiation or a manual reset (Step 213) the counter value is set to 1. The time delay variable X is restored to its default value. Step 204 and step 206 monitor the cooling unit parameters. In this example the cooling unit parameters which are communicated to the control unit are temperatures. Proceeding to step 204, if the stored set point temperature (SP22) is less than the measured temperature (T22), proceed to step 208. If SP22 is greater than or equal to T22 proceed to step 206. At step 206, if SP21 is less than T21 proceed to step 208. If SP21 is greater than or equal to T21 loop back to step 204. Step 208, turn off appropriate heat input to cooling unit and proceeded to step 210. Step 210, compare counter value to maximum number of allowed restart attempts stored in restart variable Z. If counter value is greater than Z proceed to step 212. If the counter value is less than Z, proceed to step 214. If step 212 has been initiated, the heat source remains locked out and an operator warning signal is sent to control panel (20). The operator warning signal informs the operator that the heat source has been locked out and provides the operator the opportunity to correct any potential problems such as the cooling unit not being level. Step 213, the operator acknowledges the heat source lock out by a method such as pressing a manual reset button which returns to step 202, initiating a system reset. If step 214 has been initiated, the controller starts a timing period t defined by X. Once the timing period t has elapsed, or the period t is greater than X, proceed to step 216. Step 216, restart appropriate heat source and proceed to step 218. Step 218; confirm cooling unit heat source has successfully restarted by sensing an increasing temperature at temperature sensor. If confirmed that the temperature is increasing at heat source proceed to step 220. If heat source temperature is not increasing proceed to step 219. Step 219, use system restart variable as the maximum number of times to attempt a restart of the heat source. If attempts to restart heat source are less than Z attempts, loop back to 216. If attempts are greater than Z proceed to 212. Finally, once the heat source has been confirmed to be successfully restarted in step 218, proceed to step 220. Step 220, increase the counter value by one and increase the time delay variable X by doubling its value (2*X), then loop back to step 204.

Alternative Embodiments

Any cooling unit parameter which indicates cessation of the refrigerant may be used by the ARP controller for protection of the cooling unit. For example, pressure sensor 24 can be used in place of temperature sensors 21 or 22 as the control unit sensor input. A pressure sensor can take the place of the temperature sensor due to the fact that pressure and temperature are related in a closed system where the volume, mass, and components (refrigerant) within the closed system remain constant. Therefore, the cooling unit parameters measured by the temperature measurements have a direct relationship to the cooling unit internal pressure.

The ARP controller can have combinations of sensors that achieve the end result of protecting the integrity of the cooling unit. These sensors would take direct readings from the cooling unit (25) in order to react rapidly to a destructive condition. Combinations would include, but not be limited to, differential temperature, system level, refrigerant level, or a combination of pressure, temperature and/or level measurement. A partial list of sensors measuring the cooling unit parameters include, but are not limited to, temperature sensors such as TCs, thermistors, resistance type (RTDs and PRTs), and semiconductor type (ICs and diodes). Flow sensors such as differential pressure, vane type, and displacement. Level sensors such as float, electrical conduction, mercury switch, capacitance, and magnetostrictive.

Finally, modulation of the heat input can be another function of the ARP controller. Modulation of the heat input can keep the system within predefined safe operation parameters. When the heat source is abruptly turned off, large temperature differentials are introduced at the boiler. These temperature differentials result in large thermal stress which can result in cracks, especially around welded components such as the electrical and gas heater attachments. Therefore, modulation of the heat source by a rate of heat input reduction will help reduce thermal stress.

Conclusion, Ramifications, and Scope

With an understanding of the absorption refrigeration process and the different methods which manufacturers of SPAR units use to control the systems, the reader is given the tools to understand the parts which cooperate in order to maintain the absorption refrigeration process. Further, the problems associated with heat input when the absorption refrigeration cycle has ceased has been included to provide the reader with an understanding of the need for the ARP controller. The ARP controller is distinguished from other types of absorption refrigeration controllers by an improvement in the method of sensing and controlling conditions which lead to premature failure of a SPAR system.

The ARP controller may be configured to either cooperate with existing manufacturers' controllers or be used as a stand-alone controller. The ARP controller may be included within a manufacturers' or an aftermarket refrigeration controller which controls all aspects of the refrigerator. In addition, the ARP controller may take the form of an analog or microprocessor controller.

The ARP controller will be adaptable to function with different configurations of SPAR systems. The adaptability of the ARP controller is a result of its use of sensors at various locations on the cooling unit for direct measurement of cooling system parameters based on the particular configuration of absorption refrigeration system being controlled. Each cooling unit design has unique measurable parameters which can be used to detect whether the system is functioning as a continuous cycle. The actuators adjusting the heat source are also adaptable to the method of heat input to the particular configuration of absorption refrigeration system being controlled. Heat sources other than electrical or gas heat inputs are not addressed by this document. Other heat sources are covered under the scope of this invention. Further, the scope of this invention covers modulation of the heat source for the purpose of keeping the absorption process within safe limits.

Although the description above contains many specificities, these should not be construed as limiting the scope of the invention but as merely providing illustrations of some of the presently preferred embodiments of this invention. Thus the scope of the invention should be determined by the appended claims and their legal equivalents, rather than by the examples given.

I claim:

1. An automatic protective controller circuit for a single pressure absorption refrigeration cooling unit, comprising:

(a) one or more temperature sensors in thermal contact with a portable single pressure absorption cooling unit containing an absorption cycle using a pump tube with a percolator effect for transport of refrigerant fluids, wherein the pump tube is surrounded by a weak solution of refrigerant, wherein the weak solution comprises water and an inhibitor depleted of ammonia, wherein each temperature sensor is located at a point along the weak solution flow, wherein the weak solution has a temperature, and wherein each temperature sensor measures the temperature of the weak solution along the weak solution flow at the point on the cooling unit at which the sensor is located;

(b) electrical circuitry that compares the measured temperature of the weak solution at each point to a predetermined value for that point; and (c) one or more actuators that reduce heat input to the single pressure absorption refrigeration cooling unit;

wherein the electrical circuitry activates the one or more actuators based on the comparison between the measured temperatures and the predetermined values, and if the measured temperature at any point along the weak solution flow is greater than the predetermined value for that point, then the one or more actuators is activated;

wherein heat input to the cooling unit is adjusted based on measured temperature increase of the weak solution due to off-level tilting condition resulting cessation of refrigerant flow, to protect the cooling unit from excessive thermal stress caused by off-level tilting.

2. The automatic protective controller circuit of claim 1, wherein the sensors are located within a boiler assembly casing.

3. The automatic protective controller circuit of claim 1, in combination with said single pressure absorption refrigeration cooling unit.

4. A method for automatically controlling a heat input of a single pressure absorption refrigeration cooling unit thereby providing protection of the cooling unit, comprising the steps of:

(a) measuring temperature of a weak solution using one or more temperature sensors in thermal contact with the portable single pressure absorption cooling unit containing an absorption cycle using a pump tube with a percolator effect for transport of refrigerant fluids, wherein the pump tube is surrounded by the weak solution of refrigerant, wherein the weak solution comprises water and chromate depleted of ammonia, wherein each of the temperature sensors is located and at a point along the weak solution flow wherein the weak solution has a temperature, and wherein each of the temperature sensors measures the temperature of the weak solution along the weak solution flow at the point on the cooling unit at which the sensor is located;

(b) comparing the measured temperature of the weak solution at each point to a predetermined value for that point, using electrical circuitry; and (c) adjusting the heat input to the single pressure absorption refrigeration cooling unit using one or more actuators;

wherein the electrical circuitry activates the one or more actuators based on the comparison between the measured temperatures and the predetermined values, and if the measured temperature at any point along the weak solution flow is greater than the predetermined value for that point, then the one or more actuators is activated resulting in heat input reduction; and wherein heat input to the cooling unit is adjusted based on measured temperature increase of the weak solution due to off-level tilting condition resulting cessation of refrigerant flow, to protect the cooling unit from excessive thermal stress caused by off-level tilting.

5. The method for automatically controlling the single pressure absorption refrigeration cooling unit according to claim 4, wherein the sensors are located within a boiler assembly casing.

6. An automatic protective controller circuit for protecting a single pressure absorption refrigeration cooling unit, the automatic protective controller circuit responding before undue thermal stress is placed on the single pressure absorption refrigeration cooling unit, including thermal stress due to off-level tilting, comprising:

(a) one or more temperature sensors in thermal contact with a portable single pressure absorption cooling unit containing an absorption cycle using a pump tube with a percolator effect for transport of refrigerant fluids, wherein the pump tube is surrounded by a weak solution of refrigerant, wherein the weak solution comprises water and an inhibitor, wherein each temperature sensor is located outside of a refrigerated space and at a point along the weak solution flow, wherein the weak solution has a temperature, and wherein each temperature sensor measures the temperature of the weak solution along the weak solution flow at the point on the cooling unit at which the sensor is located;

(b) electrical circuitry that compares the measured temperature of the weak solution at each point to a predetermined value for that point; and (c) the absorption cycle of the single pressure absorption refrigeration cooling unit having a working agent, and where the predetermined value is greater than the continuous phase change temperature of the working agent when the single pressure absorption refrigeration cooling unit is functioning as a continuous cycle; and (d) one or more actuators that reduce heat input to the single pressure absorption refrigeration cooling unit;

wherein the electrical circuitry activates the one or more actuators based on the comparison between the measured temperatures and the predetermined values, and if the measured temperature at any point along the weak solution flow is greater than the predetermined value, then the one or more actuators that reduce heat input is activated; and, wherein heat input to the cooling unit is thus adjusted based on measured temperature increase of the weak solution caused by off-level tilting, whereby preventing fire hazard resulting from cooling unit tubing rupture.

7. The automatic protective controller circuit of claim 6, wherein at least one of the one or more temperatures sensors is located within a boiler assembly casing.

8. The automatic protective controller circuit of claim 6, wherein at least one of the one or more temperature sensors is located at the weak solution fluid level.

9. The automatic protective controller circuit of claim 6, in combination with said single pressure absorption refrigeration cooling unit.

10. A method of automatically controlling a heat input of a single pressure absorption refrigeration cooling unit using off-level and tilting condition thereby providing protection of the cooling unit, comprising the steps of:

(a) measuring temperature of a weak solution using one or more temperature sensors in thermal contact with the portable single pressure absorption cooling unit containing an absorption cycle using a pump tube with a percolator effect for transport of refrigerant fluids, wherein the pump tube is surrounded by the weak solution of refrigerant, wherein the weak solution comprises water and an inhibitor, wherein each of the temperature sensors is located outside of a refrigerated space and at a point along the weak solution flow wherein the weak solution has a temperature, and wherein each of the temperature sensors measures the temperature of the weak solution along the weak solution flow at the point on the cooling unit at which the sensor is located;

(b) comparing the measured temperature of the weak solution at each point to a predetermined value, using electrical circuitry; and (c) adjusting the heat input to the single pressure absorption refrigeration cooling unit using one or more actuators;

wherein the electrical circuitry activates the one or more actuators based on the comparison between the measured temperatures and the predetermined values, and if the measured temperature at any point along the weak solution flow is greater than the predetermined value, then the one or more actuators is activated resulting in heat input reduction; and wherein heat input to the cooling unit is adjusted based on measured temperature increase of the weak solution due to a discontinuity of the single pressure absorption cooling unit absorption cycle caused by off-level tilting.

11. The method for automatically controlling the single pressure absorption refrigeration cooling unit according to claim 10, wherein at least one of the one or more temperature sensors is located within a boiler assembly casing.

12. The method for automatically controlling the single pressure absorption refrigeration cooling unit according to claim 10, wherein the predetermined value is greater than the continuous phase change temperature of a working agent contained within the single pressure absorption refrigeration cooling unit when the absorption cycle is functioning as a continuous cycle.

13. The method for automatically controlling the single pressure absorption refrigeration cooling unit according to claim 12, further comprising displaying a warning on a control panel indicating the continuous cycle of the single pressure absorption cooling unit was intervened.

* * * * *